US008402562B1

(12) United States Patent
Seddiki

(10) Patent No.: US 8,402,562 B1
(45) Date of Patent: Mar. 26, 2013

(54) GARMENT WITH A POCKET SYSTEM FOR AN ELECTRONIC DEVICE

(75) Inventor: Maade Seddiki, Nyack, NY (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 238 days.

(21) Appl. No.: 12/914,588

(22) Filed: Oct. 28, 2010

(51) Int. Cl.
*A41D 3/02* (2006.01)

(52) U.S. Cl. ..... 2/94; 2/247

(58) Field of Classification Search ..... 2/69, 93, 2/94, 102, 115, 247–254
See application file for complete search history.

(56) References Cited

U.S. PATENT DOCUMENTS

| | | | | |
|---|---|---|---|---|
| 2,312,177 | A * | 2/1943 | Lester | 2/253 |
| 3,047,877 | A * | 8/1962 | Palazzo | 2/94 |
| 4,637,075 | A | 1/1987 | Ingrisano et al. | |
| 5,195,187 | A | 3/1993 | Yang | |
| 5,509,147 | A | 4/1996 | Busquets | |
| 5,517,696 | A | 5/1996 | Krugler | |
| 6,105,170 | A | 8/2000 | Lisciandro et al. | |
| 6,175,966 | B1 | 1/2001 | Wiesenthal | |
| 6,199,210 | B1 | 3/2001 | Feldman | |
| 6,324,697 | B1 | 12/2001 | Shofner | |
| 6,339,846 | B2 | 1/2002 | Uchida | |
| 6,826,782 | B2 | 12/2004 | Jordan | |
| 7,152,247 | B2 | 12/2006 | Parsons | |
| RE40,613 | E | 1/2009 | Jordan | |
| 2004/0172734 | A1 * | 9/2004 | Hartbrodt | 2/97 |
| 2006/0026735 | A1 | 2/2006 | Kensic | |
| 2007/0245444 | A1 | 10/2007 | Brink | |
| 2008/0184459 | A1 * | 8/2008 | Barnes | 2/249 |

* cited by examiner

*Primary Examiner* — Katherine Moran
(74) *Attorney, Agent, or Firm* — Womble Carlyle Sandridge & Rice, LLP

(57) ABSTRACT

A garment comprises a body portion formed from a first, body panel. The body portion has an exterior and an interior, a neck opening, a waist opening and two arm openings. The garment includes a pocket system having an interior pocket formed by a portion of the first, body panel and a second, middle panel attached to the interior of the first body panel. The interior pocket has an opening on the interior of the garment. The pocket system includes an exterior pocket formed by at least a portion of the second, middle panel and a third, innermost panel. The second and third panels have opposed edges attached to the first, body panel. The exterior pocket has an access opening on the exterior of the garment. An electronic connection from an electronic device can be made through an opening when the electronic device is placed inside the exterior pocket.

22 Claims, 6 Drawing Sheets

GARMENT WITH A POCKET SYSTEM FOR AN ELECTRONIC DEVICE

FIELD OF THE INVENTION

The present invention relates to a garment, and, more particularly to a garment having a pocket system for use with an electronic device.

BACKGROUND OF THE INVENTION

In recent years, garments designed as outerwear have been developed to provide more than just warmth and protection. Consumers value storage spaces and ease of access, regardless of whether the garment is used for outdoor activities, such as hiking or camping, or for more urban daily use.

Electronic devices, such as cell phones, media players, and smartphones are now common accessories that consumers carry and use constantly, regardless of the activity. Easy access to these electronic devices and being able to utilize the many features that these devices offer has become increasingly important, and often quite necessary, for consumers. The ability to carry, use and operate such a device, i.e., navigate from one song to the next or one application to the next, while managing the necessary wires for headsets that permit private use of the device, is desirable.

There are known garment designs that allow interconnectivity between multiple devices positioned in different pockets. The more common electronic devices used by consumers today, however, perform multiple functions, e.g., a single device is a cell-phone, a web browser, and a media player, with features that several years ago would have required two or more devices to perform. A suitable garment design that allows consumers to hold, use and manage both the device and the wires associated with the device has not heretofore been known.

There is, therefore, a need for a system for an outerwear garment that overcomes the disadvantages associated with known garment designs.

SUMMARY

The present invention is directed to a garment formed as outerwear for use with an electronic device that addresses the problems described above. In one embodiment, the garment may include a body portion formed from a first, body panel. The body portion includes an exterior and an interior, a neck opening, a waist opening, and two arm openings. The garment includes a pocket system. In one embodiment, the pocket system may have an interior pocket formed by a portion of the first, body panel and a second, middle panel attached to the interior of the first, body panel. The interior pocket has an access opening on the interior of the garment. The pocket system may include an exterior pocket formed by at least a portion of the second, middle panel and a third, innermost panel. The second and third panels have opposed edges attached to the first, body panel. The exterior pocket has an access opening on the exterior of the garment. There also may be an opening in the third panel through which an electronic connection from an electronic device can be made when the electronic device is placed inside the exterior pocket.

DETAILED DESCRIPTION

Figure 1:
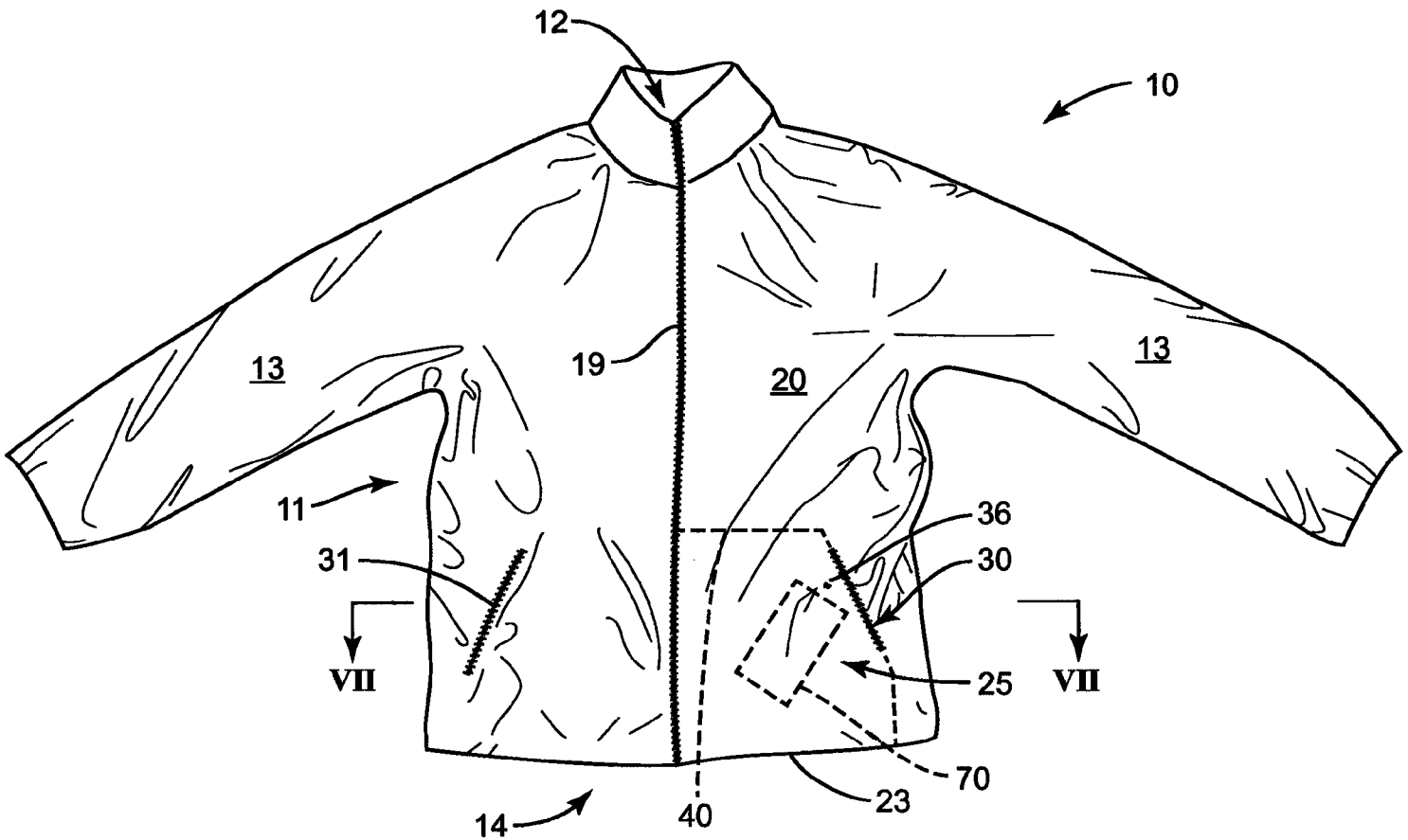
FIG. 1 is a front plan view of an exemplary garment of the present invention.

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

According to common practice, the various features of the drawings discussed below are not necessarily drawn to scale. Dimensions of various features and elements in the drawings may be expanded or reduced to more clearly illustrate the embodiments of the invention.

Figure 2:
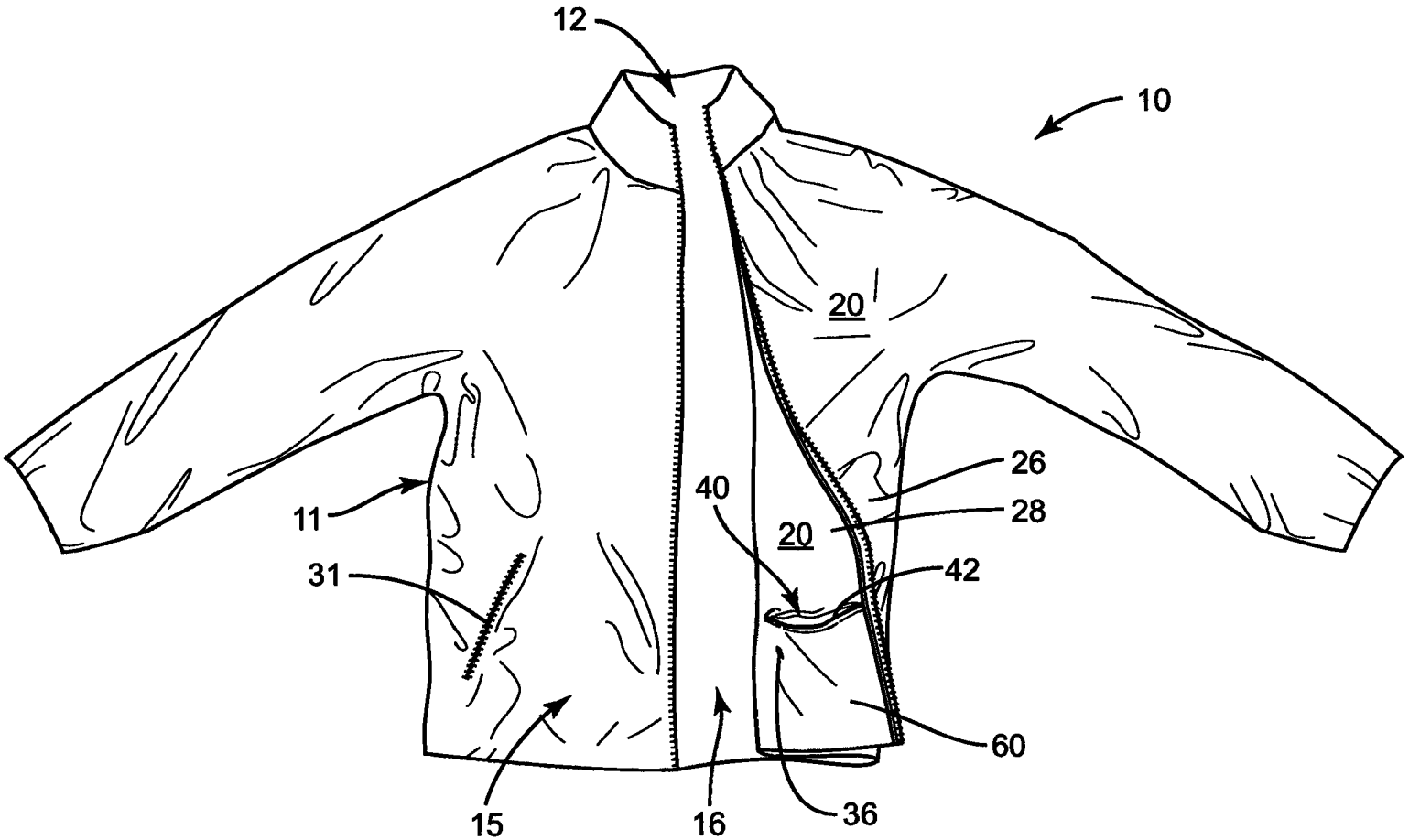
FIG. 2 shows another view of an exemplary garment showing the interior thereof.

FIGS. 1 and 2 illustrate an exemplary garment 10 according to one embodiment of the invention. As shown in FIGS. 1 and 2, the garment 10 may include a body portion 11, neck opening 12, sleeves 13, a waist opening 14, and a pocket system 25 on the body portion 11. The pocket system 25 includes a first exteriorly accessible pocket 30, a second interior pocket 40 (shown in hidden lines in FIG. 1) inside the garment 10, and a third pocket 70 inside the exterior pocket 30. In this embodiment, an opening 36 is formed in the exterior pocket 30, through which a wire connected to an electronic device held therein may pass through to the inside 16 of the garment 10. The interior pocket 40 allows items to be held therein without interfering with the electronic device and wire in the pocket 30. As will be further discussed below, the pocket system 25 includes a plurality of panels to accomplish the separation between the exterior and interior pockets 30 and 40, respectively. The garment 10 may include additional pockets as needed, e.g., an additional exterior pocket 31 shown in FIG. 1.

The garment may be a front closure jacket as shown in the Figures. In other embodiments, however, the garment may be a pullover, a sleeveless vest, a hooded jacket, or other outerwear garment. The word "outerwear" as used herein refers to garments intended to be worn over next-to-skin garments, e.g., shirts and the like.

Continuing with FIGS. 1 and 2, the garment 10 may include a front closure 19 to selectively open and close the front of the garment 10. A zipper type closure is shown, however, any closure may be used, e.g., buttons, snaps, hook and latch, a loop and toggle system, etc. As shown, the front closure 19 extends from the neck opening 12 to the bottom edge 23 of the garment 10. In other embodiments, as described above, the garment may be a vest having a front closure extending from the waist opening to the neck opening. In other embodiments, however, the garment 10 may be a quarter-zip jacket or half zip jacket, i.e., the closure may extend to, but not meet, the bottom edge 23 of the garment.

As shown in FIGS. 2, 5, 6 and 7, the body portion 11 may be formed of a single layer panel 20 having an exterior surface 26 and an interior surface 28. A "single layer," as used herein, means a single panel of a fabric, or a laminate of two or more fabrics where a substantial portion of the surface of one fabric is bonded to a substantial portion of the surface of another fabric to form the laminate. Accordingly, the panel 20 may be formed as a knit or woven textile. In one embodiment, the panel 20 may be a knit fabric formed of polyester yarns. Any fiber type, however, may be used, e.g., cotton, wool, polyester, polyamide, polyolefin, or combinations thereof. Further, various yarn types may be used to form the body panel 20, e.g., staple yarns and/or continuous filament yarns. The body panel 20 may have any weight suitable for outerwear applications. In one embodiment, the weight of the fabric panel may be at least about 100 g/m$^2$. As discussed above, the body panel 20 may be a bonded laminate of one or more fabrics. In still other embodiments, the panel 20 may be formed of fabrics that include coatings, finishes or other functional additives applied thereto, or include fabrics that have been mechanically finished, e.g., brushing, etc.

Figure 3:
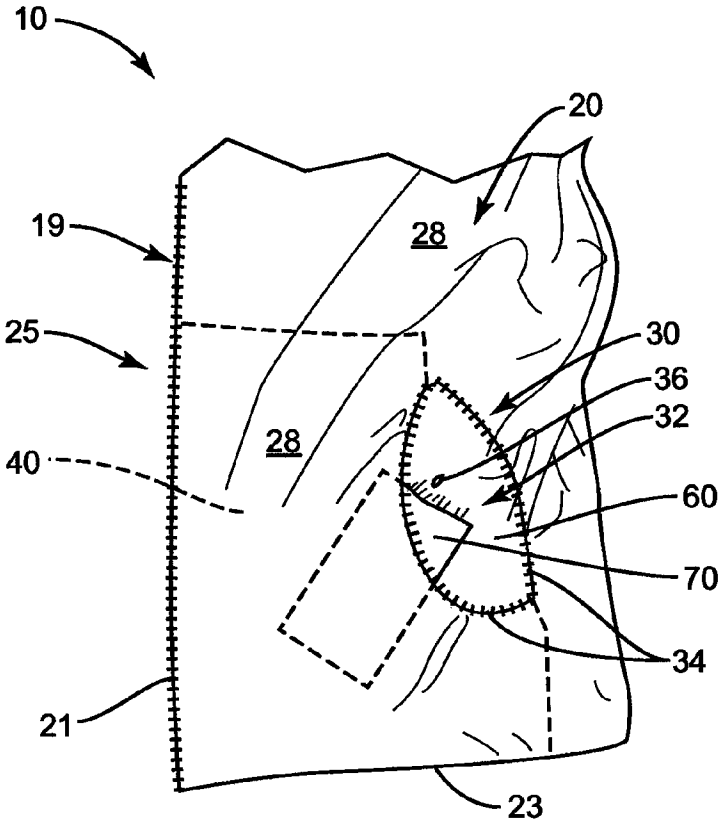
FIG. 3 shows a cut-away of the exterior of an exemplary garment and the pocket system thereon.
Figure 4:
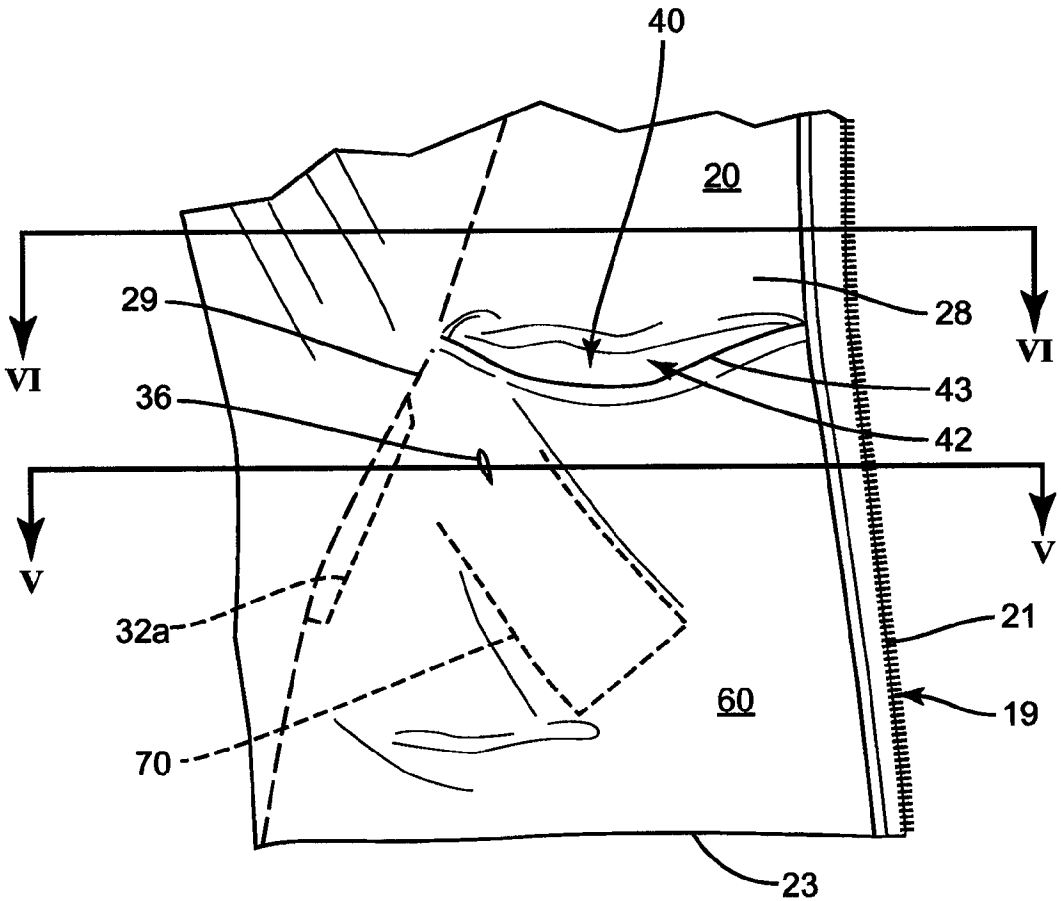
FIG. 4 shows a cut-away of the interior of an exemplary garment and the pocket system thereon.
Figure 5:
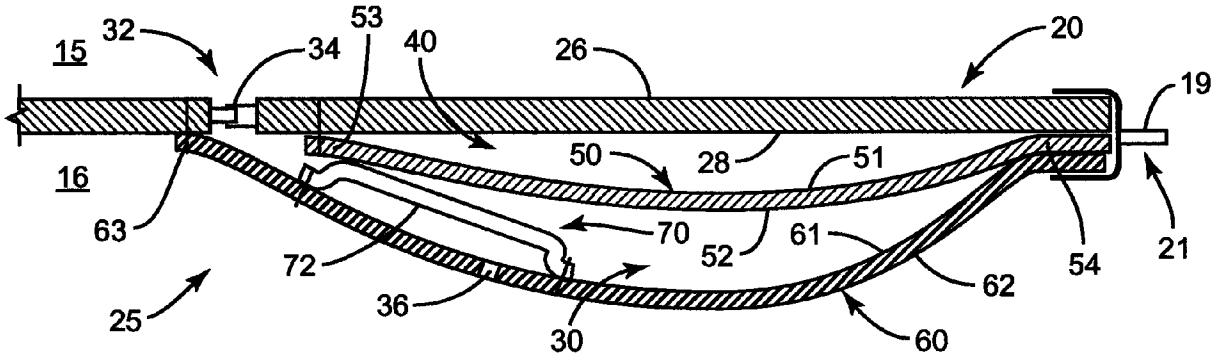
FIG. 5 shows a cross-section of a portion of an exemplary garment taken along lines V-V in FIG. 4.

FIGS. 1 through 5 show a pocket system 25 that may include a plurality of pockets formed by a portion of the body panel 20, a second middle panel 50 (shown in FIG. 5) and the third innermost panel 60 (also shown in FIG. 5). As can be seen in FIGS. 1 and 2, the exterior pocket 30 has access from the exterior 15 of the garment, while the interior pocket 40 is shown having an access opening 42 on the interior 16 of the garment 10. A third pocket 70 may be inside the exterior pocket 30 and is also accessible from the exterior 15 of the garment 10.

FIGS. 3 and 4 show exterior and interior views of the pocket system 25, respectively. As shown in FIG. 3, the first panel 20 has thereon an exterior pocket 30, an exterior access opening 32, and an optional closure 34 for selectively opening and closing the pocket 30. The closure 34 is shown as a zipper, however, snaps or other closure types may be used as well. In still other embodiments, the pocket 30 may be open and have no closure. The pocket 30 is shown open, which illustrates wire opening 36 proximate the third pocket 70 and on the third inner most panel 60, as will be further discussed below. The exterior pocket 30 may be proximate the front 21 and bottom edge 23 of the garment 10. Also shown in FIG. 3 in phantom lines is the position of interior pocket 40 also proximate the front 21 and bottom edge 23 of the garment 10.

Turning now to FIG. 4, the interior 16 of the garment 10 and pocket system 25 is shown. The interior pocket 40 includes an interior opening 42 adjacent the interior surface 28 of the first body panel 20. An upper edge 43 forms the access opening 42 with the body panel 20. The body panel 20 may extend down into the pocket 40 and also upwardly forming the body portion 11. A wire and connector for an electronic device may pass through the opening 36 on the panel 60. Stitching 29 may form a portion of the perimeter of the pocket 40. Along the stitch line 29 are shown phantom lines 32*a* which illustrate the location of the access opening 32 of the exterior pocket 30 on the opposite side of the body panel 20, i.e., on the exterior 15 of the garment.

Figure 6:
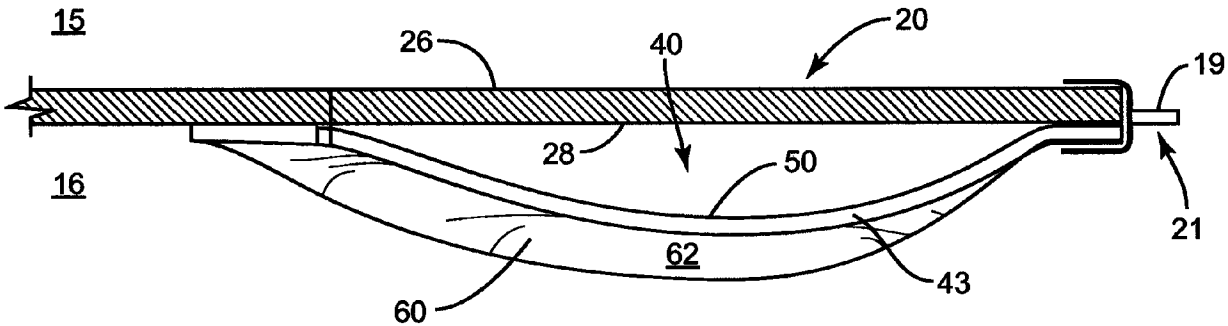
FIG. 6 shows a cross-section of another portion of the exemplary garment taken along lines VI-VI in FIG. 4.

FIGS. 5 and 6 illustrate how the first panel 20, second middle panel 50, and third innermost panel 60 from the pockets 30 and 40. As will be detailed below, the interior pocket 40 may be formed by the middle panel 50 and a portion of the body panel 20, while the exterior pocket 30 is formed by the middle panel 50 and the third panel 60.

As shown in FIG. 5, the second middle panel 50 has a first surface 51 and second opposing surface 52. The first surface 51 of the panel 50 is connected to the interior surface 28 of the body panel 20. First side edge 53 of the middle panel 50 may be secured to the first body panel 20 proximate the access opening 32. The opposite side edge 54 of panel 50 may be secured to the first body panel 20 proximate the front edge 21 of the garment 10. The space between the middle panel 50 and the body panel 20 form the inside of the interior pocket 40.

As also shown in FIG. 5, the third innermost panel 60 has a first surface 61 and a second surface 62. The third panel 60 is secured in part to the body panel 20 proximate the access opening 32 and to the second surface 52 of the middle panel 50. The first side edge 63 of the third panel 60 may be secured to the interior surface 28 of the body panel 20 proximate the access opening 32 and separated from where side edge 53 of the middle panel 50 is secured to the same surface 28 of the body panel 20. In other portions of the pocket system 25, the side edges 53 and 63 may be secured together on the body panel 20. For example, the side edges 53 and 63 may all be secured on the body panel 20 above and below the access opening 32 (as shown in FIG. 4). The space between the middle panel 50 and the third panel 60 form the inside of the exterior pocket 30. The body panel 20, middle panel 50, and third, innermost panel 60 may be secured together along the front edge 21 of the garment 10.

Turning to FIG. 6, a cross-section of the body panel 20 at a position above the opening 42 of the interior pocket 40 is shown. The upper edge 43 may be the common upper edges of the second, middle panel 50 and a third, innermost panel 60.

Returning again to FIG. 5, the access opening 32 permits access to the inside of the exterior pocket 30 through the first body panel 20.

The third pocket 70 shown in FIG. 5 may be formed by a third pocket panel 72 secured to the first surface 61 of the third, innermost panel 60. The opening 36 may be located proximate the third pocket 70. The opening 36 is sized to allow a wire and electronic connection for headphones to pass therethrough. A grommet or other device (not shown) may be added to the border of the opening 36 to protect the edge of the opening 36. The third pocket 70 may be used for holding any type of electronic device as described above. For example, the pocket 70 may be a band secured to a panel in the exterior pocket 30 for holding an electronic device.

Figure 7:
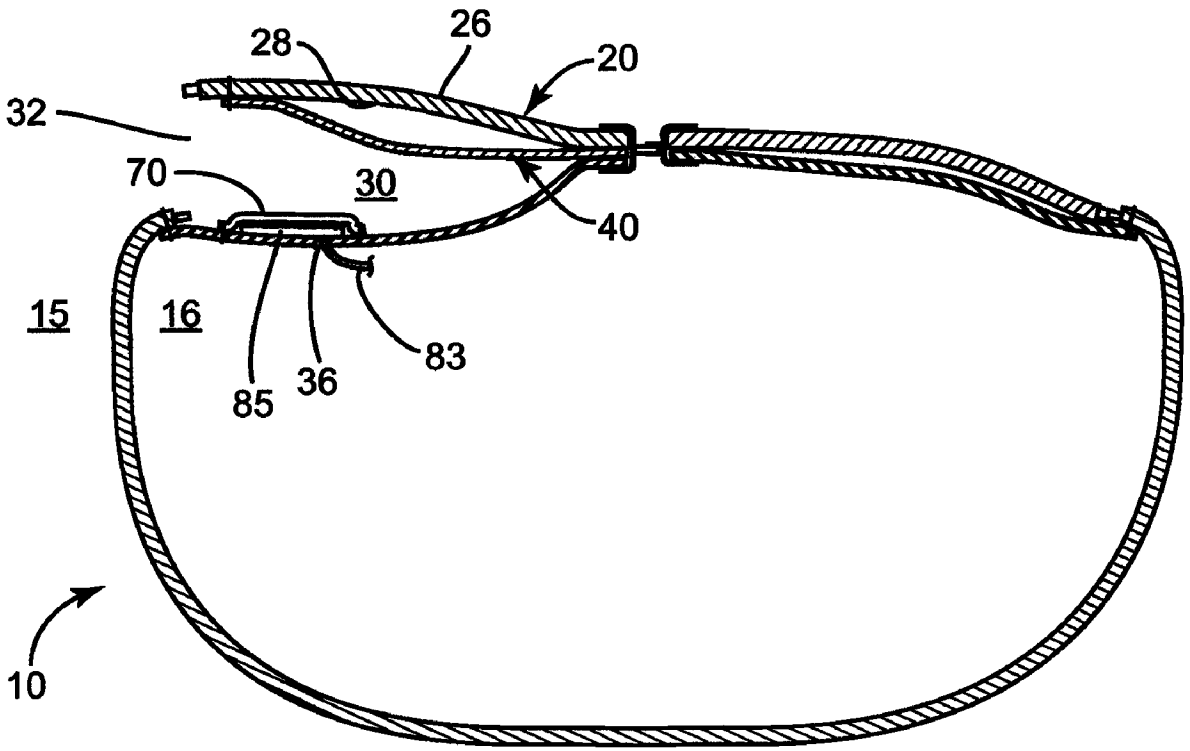
FIG. 7 shows a cross-section of an exemplary garment taken along lines VII-VII in FIG. 1.

FIG. 7 is a cross-sectional view of the exemplary embodiment of the pocket system 25 in the garment 10. As shown in FIG. 7, the pocket 30 may be accessed from the exterior 15 of the garment 10 through the opening 32 to allow a user to place an electronic device therein or within the third pocket 70. In the embodiment shown, the electronic device 85 is located inside pocket 70. A wire 83 is shown connected to the device 85 and extending through the opening 36. The user may selectively open and close the exterior pocket 30 with the closure 34 (not shown). The user also may access pocket 40 on the interior 16 of garment 60, without interfering with whatever may be inside pocket 30.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A garment for use with an electronic device, the garment having an interior and an exterior and comprising:

a body portion formed from a first, body panel, the body panel having an exterior and an interior, a neck opening, a waist opening and two arm openings;

a pocket system comprising:

an interior pocket formed by a portion of the first, body panel and a second, middle panel attached to the interior of the first, body panel and positioned between the first, body panel and a third, innermost panel, the interior pocket having an access opening on the interior of the garment;

an exterior pocket formed by at least a portion of the second, middle panel and the third, innermost panel, the second and third panels having opposed edges attached to the first, body panel, the exterior pocket having an access opening on the exterior of the garment; and an opening in the third, innermost panel through which an electronic connection from an electronic device can be made when the electronic device is placed inside the exterior pocket.

2. The garment of claim 1, further comprising a third pocket inside the exterior pocket for holding the electronic device.

3. The garment of claim 2, wherein the third pocket is formed by a fourth panel affixed to the third, innermost panel.

4. The garment of claim 1, wherein the access opening on the exterior of the garment extends through the first, body panel.

5. The garment of claim 1, wherein the third, innermost panel and the second, middle panel each have a perimeter, at least a portion of each perimeter is attached to the first, body panel.

6. The garment of the claim 1, wherein the third, innermost panel has an upper edge and the second, middle panel has an upper edge, the third panel upper edge and the middle panel upper edge are secured together to form a common upper edge of the exterior pocket and the interior pocket, the access opening of the interior pocket formed by the common upper edge and the first, body panel.

7. The garment of claim 1, wherein the opening on the third, innermost panel is proximate the a common upper edge.

8. The garment of claim 1, wherein the garment is selected from the group consisting of a front closure jacket, a pullover, and a front closure hooded sweatshirt.

9. The garment of claim 1, wherein the body portion further comprises first and second front edges that are selectively closeable, and a bottom edge, and the pocket system is proximate the first edge and the bottom edge.

10. A garment having a pocket system for an electronic device comprising:

a body having an interior and an exterior and a first, body panel;

a neck opening on the body;

a pair of arm openings;

a waist opening;

a pocket system comprising:

an interior pocket formed by a portion of the first, body panel and a second, middle panel attached to the interior of the first, body panel and positioned between the first, body panel and a third, innermost panel, the interior pocket having an access opening on the interior of the garment;

an exterior pocket formed by at least a portion of the second, middle panel and the third, innermost panel, the second and third panels having opposed edges attached to the first, body panel, the exterior pocket having an access opening on the exterior of the garment that extends through the first, body panel; and an opening in the third, innermost panel through which an electronic connection from an electronic device can be made when the electronic device is placed inside the exterior pocket.

11. The garment of claim 10, further comprising a means inside the exterior pocket for holding an electronic computer device.

12. The garment of claim 10, further comprising a third pocket inside the exterior pocket for holding the electronic computer device.

13. The garment of claim 10, wherein the third pocket is formed by a fourth and affixed to an inner surface of the third, innermost panel.

14. The garment of claim 10, wherein the third, innermost panel and the second, middle panel have a similar size and shape.

15. The garment of claim 10, wherein the third, innermost panel has an upper edge and the second, middle panel has an upper edge, the third panel upper edge and the middle panel upper edge are secured together to form a common upper edge of the exterior pocket and the interior pocket.

16. The garment of claim 15, wherein the opening on the third, innermost panel is proximate the common upper edge.

17. The garment of claim 10, further comprising a closure that extends from the neck opening toward a bottom edge of the first, body panel, the pocket system proximate the bottom edge of the jacket.

18. A garment for a holding an electronic device comprising:

a body comprising an interior and an exterior and a first, body panel;

a neck opening;

a bottom edge whereby when the garment is worn the bottom edge extends to or below the wearer's waist;

a pair of sleeves for the wearer's arms to extend through;

a pocket system comprising:

an interior pocket formed by a portion of the first, body panel and a second, middle panel attached to the interior of the first, body panel and positioned between the first, body panel and a third, innermost panel, the interior pocket having an access opening on the interior of the garment;

an exterior pocket formed by at least a portion of the second, middle panel and the third, innermost panel, the second and third panels having opposed edges attached to the first, body panel, the exterior pocket having an access opening on the exterior of the garment;

an opening in the third, innermost panel through which an electronic connection from an electronic device can be made when the electronic device is placed inside the exterior pocket; and a third pocket inside the exterior pocket for holding the electronic computer device.

19. The garment of claim 18, wherein the third pocket is formed by a fourth panel affixed to an inner surface of the third, innermost panel.

20. The garment of claim 18, wherein the third, innermost panel has an upper edge and the second, middle panel has an upper edge, the third panel upper edge and the middle panel upper edge are secured together to form a common upper edge of the exterior pocket and the interior pocket.

21. The garment of claim 20, wherein the opening on the third, innermost panel is proximate the common upper edge.

22. The garment of claim 18, further comprising a closure that extends from the neck opening toward a bottom edge of the first, body panel, the pocket system proximate the bottom edge of the garment.

* * * * *